US005423117A

United States Patent [19]

Okada et al.

[11] Patent Number: 5,423,117

[45] Date of Patent: Jun. 13, 1995

[54] METHOD FOR FABRICATING SOLENOID DEVICE FOR ELECTROMAGNETIC VALVES

[75] Inventors: Yoichiro Okada; Ryushirou Kaneko; Keisuke Shimauchi, all of Yawara, Japan

[73] Assignee: SMC Corporation, Tokyo, Japan

[21] Appl. No.: 179,665

[22] Filed: Jan. 11, 1994

[51] Int. Cl.[6] ..... H01F 41/02

[52] U.S. Cl. ..... 29/605; 264/272.19; 336/96

[58] Field of Search ..... 29/605, 602.1; 336/96, 336/192; 264/272.19

[56] References Cited

U.S. PATENT DOCUMENTS

| | | | |
|---|---|---|---|
| 2,350,822 | 6/1944 | Robinson . | |
| 3,045,290 | 7/1962 | Anderson et al. . | |
| 3,130,355 | 4/1964 | Younger . | |
| 3,525,966 | 8/1970 | Wierzbinski . | |
| 5,226,220 | 7/1993 | Gevas et al. | 29/605 |
| 5,226,221 | 7/1993 | Kilgore | 29/605 |

FOREIGN PATENT DOCUMENTS

| | | |
|---|---|---|
| 1488373 | 4/1969 | Germany . |
| 3301502 | 8/1983 | Germany . |
| WO92/09093 | 5/1992 | WIPO . |

*Primary Examiner*—Carl E. Hall

*Attorney, Agent, or Firm*—Oblon, Spivak, McClelland, Maier & Neustadt

[57] ABSTRACT

A method for fabricating a molded solenoid device which is encased in an insulating synthetic resin shell, in which a resilient sealing cover member of an electrically insulating material is fitted on each one of a couple of solenoid coil terminals which are projected from a solenoid coil bobbin. The sealing cover members on the respective coil terminals are brought into intimate contact with inner edges of coil terminal escape holes in a mold in which a solenoid assembly is to be molded, thereby forming tight seals around the coil terminals in the coil terminal escape holes while a molten synthetic resin material is being introduced into the mold cavity around the solenoid assembly.

2 Claims, 3 Drawing Sheets

METHOD FOR FABRICATING SOLENOID DEVICE FOR ELECTROMAGNETIC VALVES

BACKGROUND OF THE INVENTION

1. Field of the Art

This invention relates to a method for fabricating a solenoid device for electromagnetic valves, and more particularly to a method for fabricating a molded solenoid device which is encased in a molded synthetic resin shell.

2. Description of the Prior Art

Generally speaking, the solenoid devices which are widely used for electromagnetic valves are largely constituted by a solenoid coil wound on a bobbin of a non-magnetic material, a couple of rod-like coil terminals projected outwardly from the bobbin and connected to the head and tail ends of the winding wire of the solenoid coil, a fixed iron core fixedly mounted in an iron core chamber coaxially at the center of the bobbin, a magnetic frame of a magnetic material located to circumvent the afore-mentioned component parts, and a movable iron core disposed movably within the iron core chamber, the circumference of the magnetic frame being embedded in an insulating synthetic resin material by molding.

In order to mold the solenoid device with an insulating synthetic resin, it has been the general practice to place, within a mold cavity, a solenoid assembly except the movable iron core, and to introduce a molten synthetic resin material into the mold cavity around the solenoid assembly. When setting the solenoid assembly in position within the mold cavity, special attention needs to be paid to the coil terminals which stick out from the bobbin to such a degree as could be an obstacle to the setting operation. In this regard, the mold is usually provided with a couple of coil terminal escape holes in which the respective coil terminals are fitted when the solenoid assembly is set in molding position in the mold cavity.

The existence of the coil terminal escape holes in the mold, however, necessitates to provide some sort of blocking means for preventing leakage of the introduced molten synthetic resin through the escape holes. One of countermeasures to this problem has been to pack a sealing member into the gap space around each coil terminal in the escape hole. This method is troublesome and time-consuming to an objectionable degree. Another method which has been resorted to in this regard is to narrow the escape holes and to bring them into direct and tight contact with the coil terminals. This method also has drawbacks that it has possibilities of damaging the coil terminals or breaking the coil winding which is connected to the coil terminals.

SUMMARY OF THE INVENTION

It is an object of the present invention to provide a method of fabricating a molded solenoid device for electromagnetic valves, the method making it possible to mold a solenoid assembly with an insulating synthetic resin material, free of leakage of molten synthetic resin material through coil terminal escape holes in a mold in a secure and facilitated manner by the use of simple means.

In accordance with the present invention, the above-stated objective is achieved by the provision of a method which essentially includes the steps of: fixedly planting a couple of rod-like coil terminal members on a bobbin of non-magnetic material; connecting one of the coil terminals to the head or leading end of a winding wire of the solenoid coil prior to winding same around the bobbin and connecting the tail end of the winding wire to the other one of the coil terminals; fitting sealing cover members of an electrically insulating resilient material on base end portions of the coil terminals in such a manner as to cover the respective connections with the winding wire of the solenoid coil; mounting a fixed iron core member within an iron core chamber at the center of the bobbin; attaching a magnetic frame around the bobbin; placing the resulting solenoid assembly within a mold with a couple of terminal escape holes, bringing the resilient sealing cover members on the respective coil terminal members into intimate contact with inner edge portions of the coil terminal escape holes; introducing a molten insulating synthetic resin material into the mold, thereby molding the solenoid assembly with the synthetic resin material together with the sealing cover members; ejecting the molded solenoid assembly in a synthetic resin insulation from the mold; and fitting a movable iron core member in the iron core chamber at the center of the bobbin.

Preferably, the above-mentioned sealing cover members are each formed in a tubular shape with a tapered circumferential surface from an intermediate portion toward one end to be located on the outer side when fitted on the terminal coils, so that they snugly fit into the coil terminal escape holes and tightly held in abutting engagement with inner edge portions of the latter.

PARTICULAR DESCRIPTION OF THE INVENTION

Figure 1:
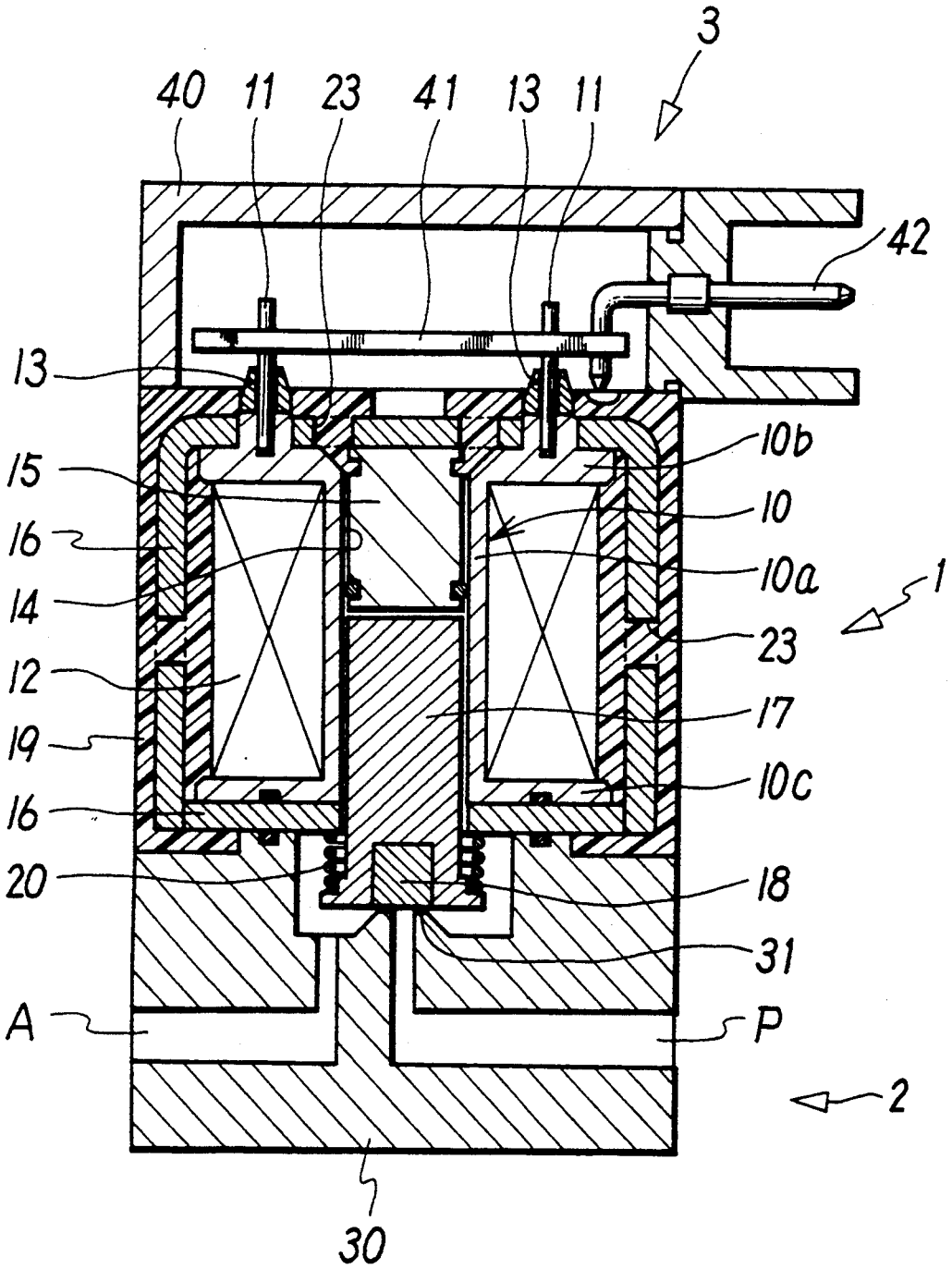
FIG. 1 is a sectional view of an electromagnetic valve incorporating a molded solenoid device fabricated by the method of the present invention.

Illustrated in FIG. 1 is an electromagnetic valve incorporating a solenoid device 1 fabricated by the method of the present invention. This electromagnetic valve is composed of a valve section 2 including an inlet port P and an outlet port A for pressurized fluid like compressed air, and a valve seat 31 provided in a fluid passage intercommunicating the inlet port P and the outlet port A, a solenoid device 1 mounted on a casing 30 of the valve section 2, and an electrical wiring section 3 mounted on top of the upper end of the solenoid device 1.

Figure 2:
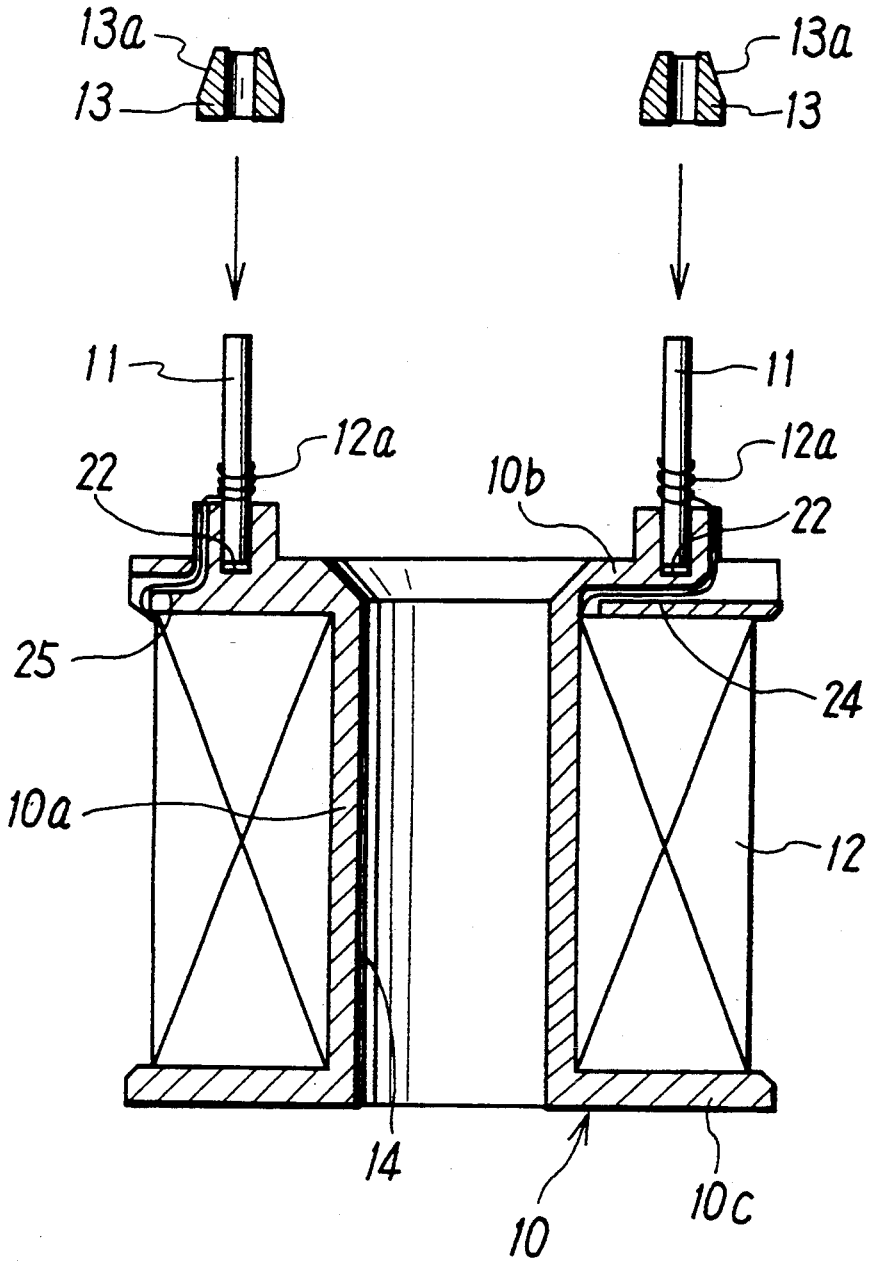
FIG. 2 is a sectional view of a solenoid assembly, explanatory of the steps of assembling solenoid device according to the method of the invention.

The solenoid device 1 includes a bobbin 10 of a non-magnetic material having flanges **10*b* and 10*c* at the upper and lower ends of a cylindrical body portion 10*a*, a couple of straight rod-like coil terminals 11 fixedly erected on the flange 10*b* at the upper end of the bobbin 10, a solenoid coil 12 formed by winding a wire 12*a* around the cylindrical body portion 10*a* of the bobbin 10 (as seen in FIG. 2) and having its head and tail ends connected to the above-mentioned coil terminals 11, respectively, resilient sealing cover members 13 of electrically insulating material fitted on base end portions of the coil terminals 11 in such a manner as to cover the connections with the winding wires, a fixed iron core 15 securely fixed in an iron core chamber 14 within the cylindrical body portion 10a of the bobbin 10, a magnetic frame 16 of a magnetic material circumventing the outer side of the bobbin 10, and a movable iron core 17 axially movably disposed in the iron core chamber 14 and provided with a valve body 18 for opening and closing the valve seat 31, the outer surfaces of the solenoid device 1 being encased in a molded shell of the insulating synthetic resin material except the areas around the outer end of the movable iron core 17 which is projected outwardly from the iron core chamber 14. The reference 20 indicates a return spring biasing the movable iron core 17 in the closing direction or in the direction toward the valve seat 31**.

The electrical wiring section 3 includes a printed wiring board 41 which is housed in a cover 40 and electrically connected to the above-mentioned coil terminals 11 and to a power supply terminal 42, the printed wiring board 41 supporting thereon various electrical parts including an indicator, resistors, counter electromotive force inhibitor and so forth although they are omitted in the drawing for the sake of simplicity of illustration.

With the electromagnetic valve of the above-described construction, upon supplying current to the coil 12 of the solenoid device 1 through the power supply terminal 42, the movable iron core 17 is electromagnetically attracted by the fixed iron core 15. As a result, the valve seat 31 is opened, permitting the pressurized fluid to flow from the inlet port P to the outlet port A. As soon as the power supply is cut off, the movable iron core 17 is returned to the position of FIG. 1 under the influence of the biasing action of the return spring 20, closing the valve seat 31 to block the flow of the pressurized fluid.

According to the invention, the solenoid device 1 is fabricated through the following steps. As seen in FIG. 2, firstly a couple of coil terminals 11 are fixedly fitted in terminal anchor holes 22 which are provided on one flange 10*b* of the bobbin 10. Nextly, the leading or head end of a winding wire 12*a* is led out through a groove 24 on the flange 10*b*, and soldered to one coil terminal 11 after being entwined around the latter several times. Then the wire 10*b* is wound on the cylindrical body portion 10*a* of the bobbin 10 to form a solenoid coil of a required number of turns, and the tail end of the winding wire 10*b* is led out through a groove 25 on the flange 10*b* and soldered to the other coil terminal 11 after being entwined around the latter several times.

Succeedingly, resilient sealing cover members 13, of an electrically insulating material like rubber or synthetic resin material, are fitted on base end portions of the coil terminals 11 in such a manner as to cover the connected ends of the winding wire 12*a*. Each of the sealing cover members 13 is formed in a short tubular shape having its outer periphery tapered toward one end to be located on the outer side when fitted on the coil terminal 11.

In the next place, the fixed iron core 15 is fixedly mounted in the iron core chamber 14 within the cylindrical body portion 10*a* of the bobbin 10, and the magnetic frame 16 is fixed around the circumference of the bobbin 10. The magnetic frame 16 is provided with radial inlet openings 23 at suitable positions to let the molding synthetic resin 19 enter and fill in the internal space of the magnetic frame 16.

Figure 3:
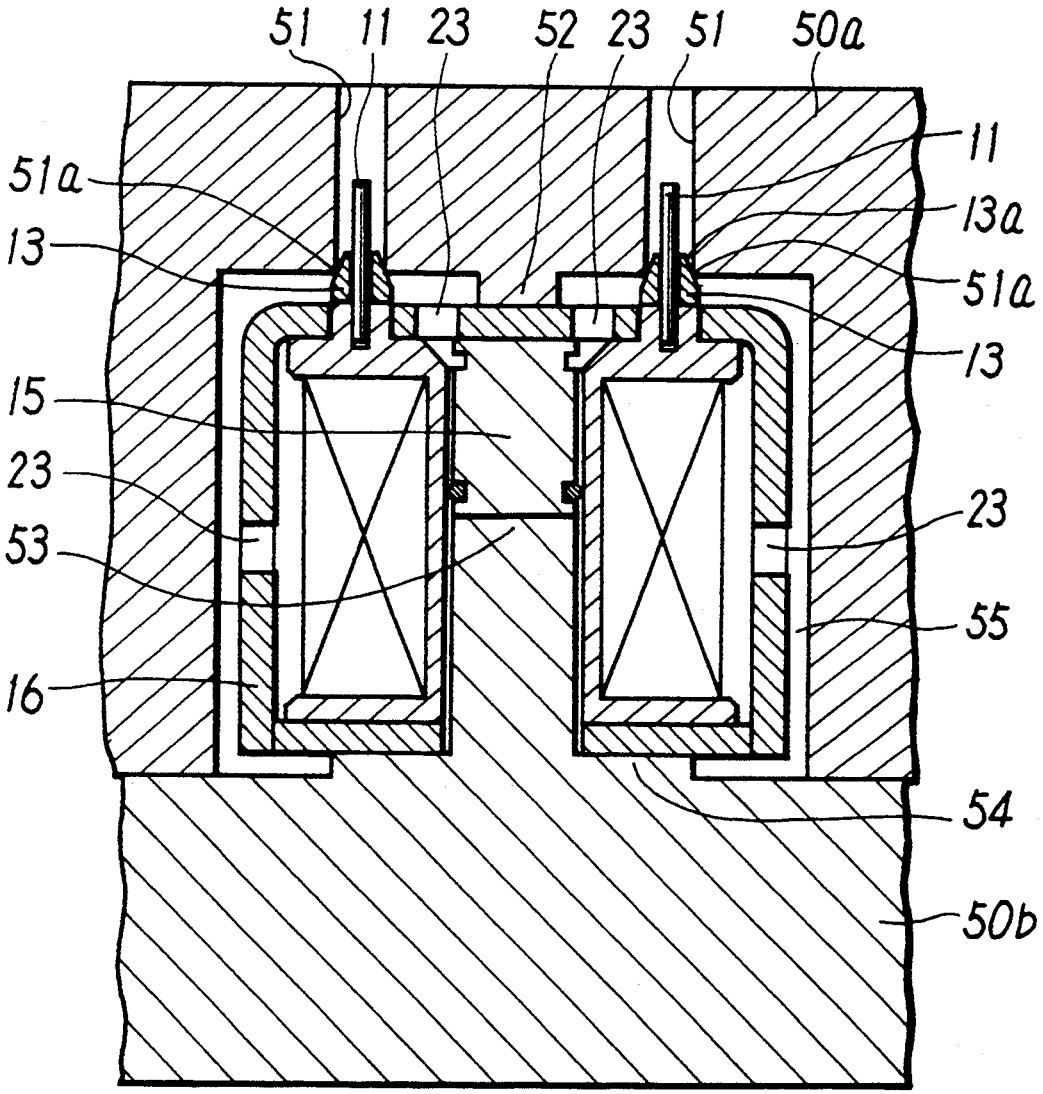
FIG. 3 is a sectional view explanatory of the method of molding the solenoid device with an insulating synthetic resin material.

The solenoid assembly which has been assembled through the above-described steps is then set in split mold members 50*a* and 50*b*, in such a way that the coil terminals 11 are fitted in a couple of coil terminal escape holes 51 as shown in FIG. 3, with the tapered portions 13*a* of the respective sealing cover members 13 held in abutting engagement with the inner edges of the latter to form seals around the coil terminals 11 in the respective escape holes 51.

One mold member 50*a* is provided with an abutting wall portion 52 to be held in engagement with the top surface of the magnetic frame 16, while the other mold member 50*b* is provided with abutting wall portion 53 to be fitted into the iron core chamber 14 for engagement with the electromagnetically attracting surface of the fixed iron core 15 and an abutting wall portion 54 to be held in abutting engagement with the bottom surface of the magnetic frame 16. After fitting the coil terminals 11 of the above-described solenoid assembly in the terminal escape holes 51 in one mold member 50*a*, the two mold members 50*a* and 50*b* are closed on one another, fitting the abutting portion 53 of the mold member 50*b* into the iron core chamber 14. Upon closing the two mold members 50*a* and 50*b*, the solenoid assembly is retained in position within the mold by the above-mentioned abutting wall portions 52, 53 and 54, and the tapered circumferences 13*a* of the sealing cover members 13 are tightly abutted against the inner marginal edges of the terminal escape holes 51 in a wedge-like fashion.

After closing the mold members 50*a* and 50*b* in this manner, molten synthetic resin material 19 is introduced into the mold cavity 55 around the solenoid assembly within the closed mold members 50*a* and 50*b* to mold the solenoid assembly. At this time, the sealing cover members 13 are embedded in the synthetic resin material 19 except their outer end portions which are partly exposed to the outside.

The synthetic resin material 19 which has been introduced into the mold cavity has no possibility of leaking to the outside through the terminal escape holes 15 since the tapered portions 13*a* of the sealing cover members 13 are tightly abutted against the inner edge portions of the escape holes 15 as described hereinbefore. Besides, the coil terminals 11 are kept from direct contact with inner edge portions 51*a* of the terminal escape holes 51, precluding the possibilities of damages to the coil terminals 11 or breakage of the coil winding 12*a*.

Finally, the mold members 50*a* and 50*b* are opened to eject the molded solenoid assembly, which is encased in the plastic insulation shell, and the movable iron core 17 is mounted in the iron core chamber 14 of the molded solenoid assembly to complete a solenoid device 1.

Thus, according to the present invention, it becomes possible to mold a solenoid assembly with a synthetic resin material 19 free of leakage of the molten synthetic resin material through the coil terminal escape holes 51 in one of the split mold members 50*a* and 50*b*, by the use of very simple means, that is to say, by the use of resilient sealing cover members 13 which are fitted on the coil terminals 11.

Needless to say, the present invention is not limited to the particular construction of the preferred embodiment described above, and it is possible for those skilled in the art to add various modifications or alterations thereto without departing from the technical scope of the invention.

What is claimed is:

1. A method for fabricating a molded solenoid device for electromagnetic valves, said method comprising the steps of:

fixedly planting a couple of rod-like coil terminal members on a bobbin of non-magnetic material for a solenoid coil;

connecting one of said coil terminals to the head or leading end of a winding wire of said solenoid coil prior to winding same around said bobbin and connecting the tail end of said winding wire to the other one of said coil terminals;

fitting sealing cover members of an electrically insulating resilient material on base end portions of said coil terminals in such a manner as to cover the respective connections with said winding wire of said solenoid coil;

mounting a fixed iron core member within an iron core chamber at the center of said bobbin;

attaching a magnetic frame around said bobbin;

placing the resulting solenoid assembly within a mold with a couple of terminal escape holes, bringing said sealing cover members on the respective coil terminals into intimate contact with inner edge portions of said coil terminal escape holes;

introducing a molten insulating synthetic resin material into said mold, thereby molding said solenoid assembly with said synthetic resin material together with said sealing cover members;

ejecting the molded solenoid assembly in a synthetic resin insulation from said mold; and fitting a movable iron core member in said iron core chamber at the center of said bobbin.

2. A method for fabricating a molded solenoid device for electromagnetic valves as defined in claim 1, wherein said sealing cover members are each formed in a tubular shape with a tapered circumferential surface from an intermediate portion toward one end to be located on the outer side when fitted on said terminal coils, said tapered circumferential surface being brought into abutting engagement with inner edge portions of said coil terminal escape holes.

* * * * *